US007237277B1

(12) United States Patent
Tsai

(10) Patent No.: US 7,237,277 B1
(45) Date of Patent: Jul. 3, 2007

(54) SHOWER NOZZLE HAVING HAIR STYLING DEVICE BACKGROUND OF THE INVENTION

(76) Inventor: Pi Kuang Tsai, 3F-6, No. 321, Daduen 4th Street, Nantun, Taichung (TW) 40867

( * ) Notice: Subject to any disclaimer, the term of this patent is extended or adjusted under 35 U.S.C. 154(b) by 0 days.

(21) Appl. No.: 11/494,006

(22) Filed: Jul. 27, 2006

(51) Int. Cl.
*A47K 3/00* (2006.01)

(52) U.S. Cl. ..... 4/615; 401/289

(58) Field of Classification Search ..... 4/615; 401/190, 282, 284, 286, 287, 289, 291; 15/160, 15/184
See application file for complete search history.

(56) References Cited

U.S. PATENT DOCUMENTS 3,055,033 A * 9/1962 Kaye et al. ..... 15/184
4,557,619 A 12/1985 DeVincentis ..... 401/190
4,988,228 A * 1/1991 Yeh ..... 401/289
5,133,103 A * 7/1992 Nagasawa ..... 15/184

* cited by examiner

*Primary Examiner*—Huyen Le
(74) *Attorney, Agent, or Firm*—Charles E. Baxley

(57) ABSTRACT

A shower nozzle includes a receptacle having a chamber enclosed by a cover, and a plate slidably received in the chamber of the receptacle and having a number of comb teeth extendible out through the openings of the cover to an outward working position and selectively movable into the receptacle to an inward storing position. One or more actuators may be rotatably disposed in the receptacle and engaged with the plate for selectively forcing the comb teeth to move out through the openings of the cover. One or more spring members may bias the comb teeth into the receptacle. A partition is disposed in the receptacle and spaced from the cover to form a space between the partition and the cover.

15 Claims, 6 Drawing Sheets

SHOWER NOZZLE HAVING HAIR STYLING DEVICE BACKGROUND OF THE INVENTION

BACKGROUND OF THE INVENTION

1. Field of the Invention

The present invention relates to a shower nozzle, and more particularly to a shower nozzle including a hair styling device slidably attached to the shower nozzle and movable out of the shower nozzle and selectively receivable into the shower nozzle for storing purposes.

2. Description of the Prior Art

Typical shower nozzles comprise a shower head including one end for coupling to a water reservoir, and another end having a number of openings formed therein for allowing the water to flow out through the openings of the shower head. However, the typical shower nozzles may only be used for water spraying purposes only but may not be used for hair styling purposes.

The typical hair styling devices, such as the combs, the hair brushes, etc. comprise a number of comb teeth extended from a comb body for hair styling purposes. However, the typical hair styling devices may only be used for hair styling purposes but may not be used for water spraying purposes.

U.S. Pat. No. 4,557,619 to DeVincentis discloses one of the typical hairbrushes including a spray can attached thereto, and a nozzle assembly having a number of nozzles in communication with one another and centrally and removably disposed within a cylindrical core and in communication with the nozzle of the aerosol spray can. However, the bristles of the typical hairbrushes may not be selectively received into the hairbrushes or may not be suitably stored.

The present invention has arisen to mitigate and/or obviate the afore-described disadvantages of the conventional shower nozzles.

SUMMARY OF THE INVENTION

The primary objective of the present invention is to provide a shower nozzle including a hair styling device slidably attached to the shower nozzle and movable out of the shower nozzle for hair styling purposes and selectively receivable into the shower nozzle for storing purposes.

The other objective of the present invention is to provide a shower nozzle including one or more actuators for selectively moving or forcing the comb teeth out of a cover of a receptacle for hair styling purposes.

In accordance with one aspect of the invention, there is provided a shower nozzle comprising a receptacle including a chamber formed therein, a cover attached to a front portion of the receptacle for enclosing the chamber of the receptacle, and including a number of openings formed therein, and a plate slidably received in the chamber of the receptacle and including a number of comb teeth extended therefrom and engaged through the openings of the cover for selectively extending out of the cover to an outward working position for hair styling purposes and for selectively moving into the chamber of the receptacle to an inward storing position.

The receptacle includes a partition disposed in the chamber of the receptacle and includes a number of apertures formed therein for slidably receiving the comb teeth of the plate. The receptacle includes a casing disposed in the receptacle and engaged with the partition for anchoring the partition to the receptacle and for suitably spacing the partition from such as a rear wall of the receptacle.

The partition is spaced from the cover to form a space between the partition and the cover, and the partition includes a pathway formed therein and communicating with the space which is formed between the partition and the cover.

The casing includes a cavity formed therein and communicating with the pathway of the partition. The partition includes a tube extended therefrom and engaged into the cavity of the casing and having the pathway formed therein for further anchoring the partition to the receptacle.

The partition is secured to the casing of the receptacle with at least one fastener. The cover includes at least one notch formed therein and aligned with the fastener for allowing the fastener to engage through the cover. The cover includes at least one cap attached thereto for selectively blocking and enclosing the notch of the cover.

The receptacle includes a biasing device for biasing the comb teeth of the plate to move into the chamber of the receptacle. The biasing device includes at least one spring member disposed between the partition and the plate for biasing and forcing the plate to move away from the partition.

The receptacle includes an actuating device for selectively actuating the comb teeth of the plate to move out through the openings of the cover. The actuating device includes at least one actuator movably disposed in the chamber of the receptacle and engaged with the plate for selectively moving the plate relative to the receptacle and for selectively forcing the comb teeth to move out through the openings of the cover.

The actuator includes a pivot shaft for rotatably attaching to the receptacle. A second actuator may further be provided and movably disposed in the chamber of the receptacle and engaged with the plate for selectively moving the plate relative to the receptacle and for selectively forcing the comb teeth to move out through the openings of the cover.

A link may further be provided and may couple the and the second actuators together. A crank may further be provided and rotatably attached to the receptacle and includes a first axle engaged with the link and a second axle rotatably engaged with the receptacle.

A hand grip may further be provided and secured to the second axle of the crank for rotating the crank and thus the actuators relative to the receptacle. The actuators each includes an arm extended therefrom and having a pivot pin for pivotally coupling to the link.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
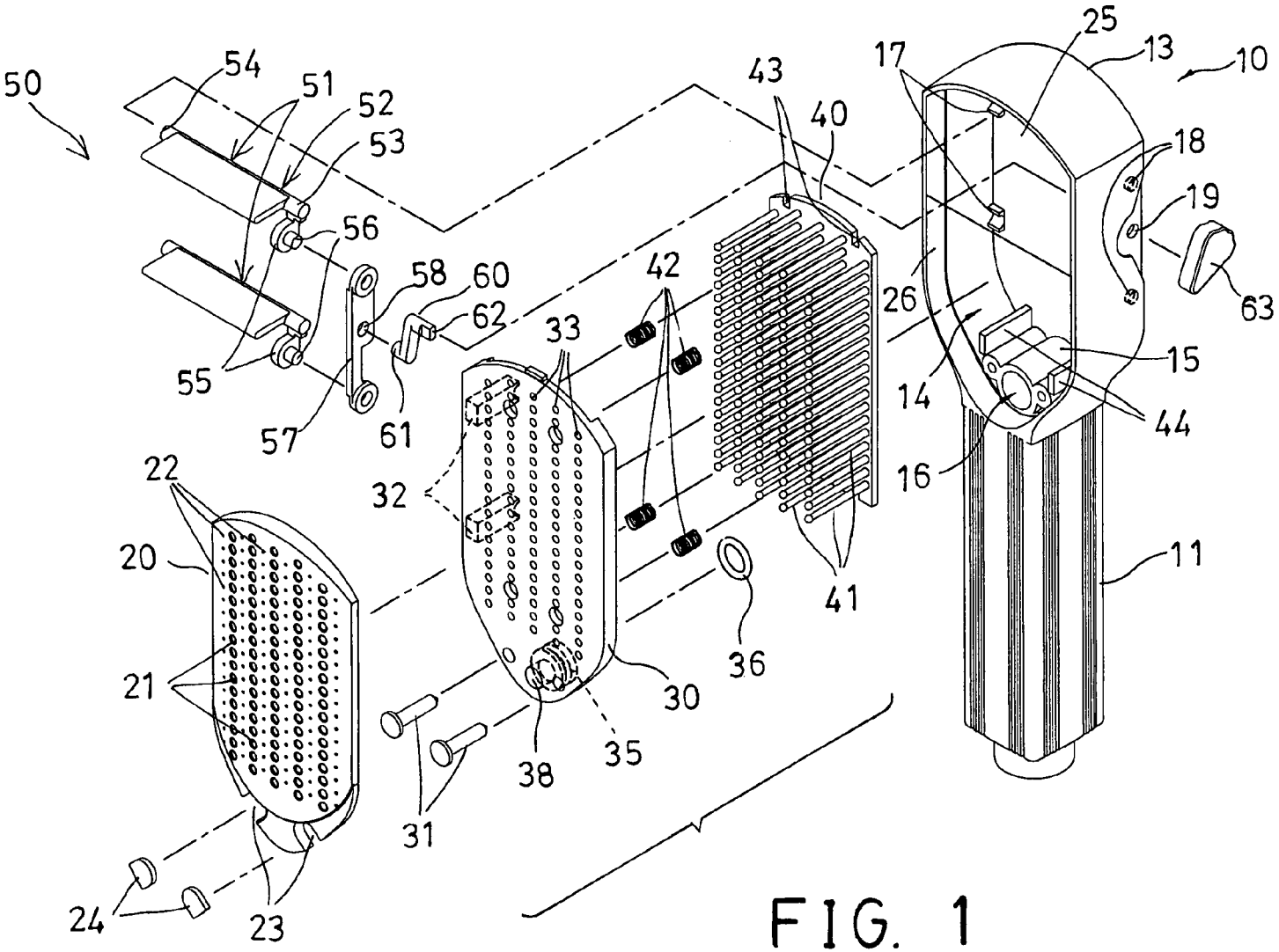
FIG. 1 is an exploded view of a shower nozzle in accordance with the present invention.
Figure 2:
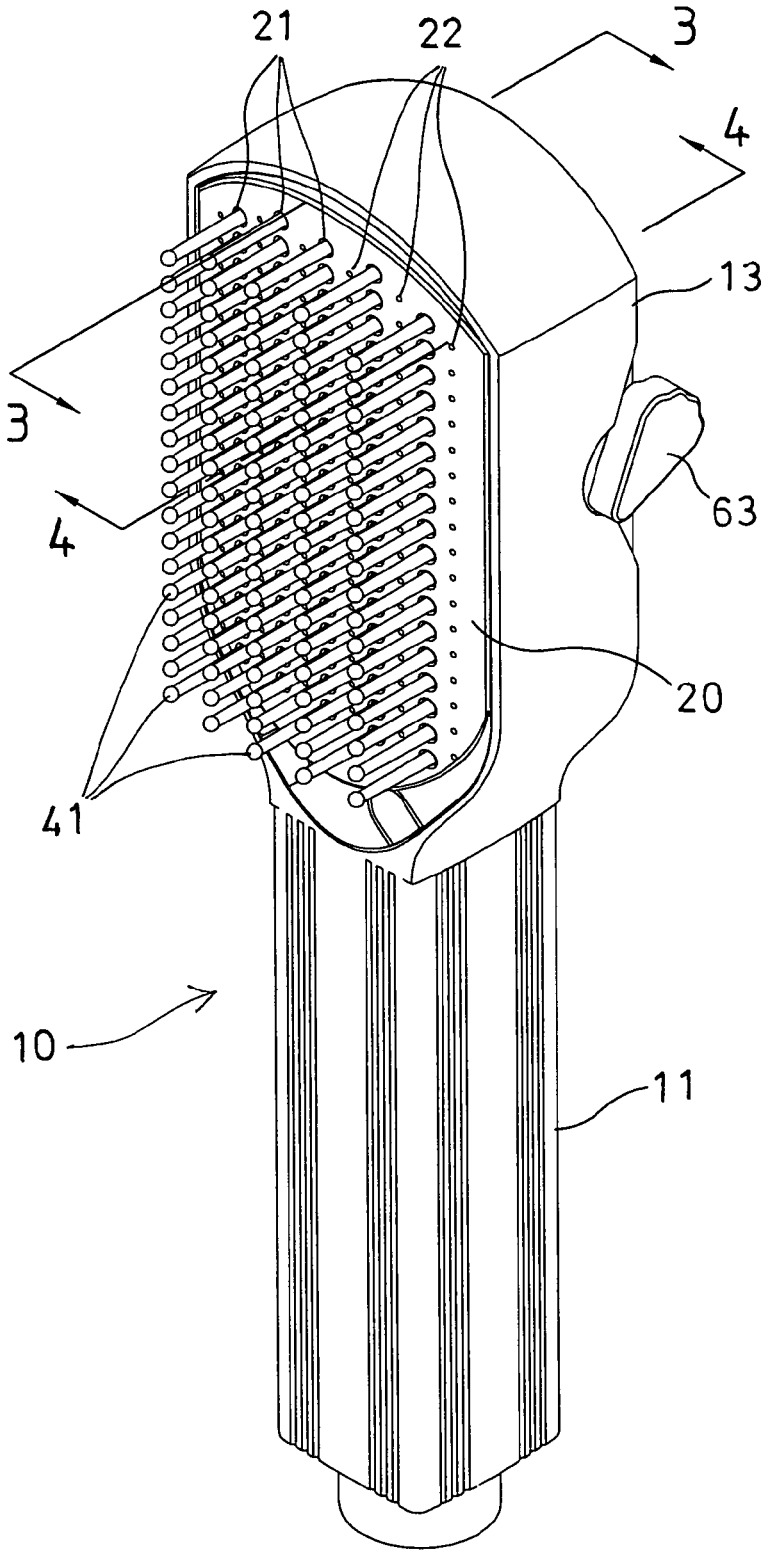
FIG. 2 is a perspective view of the shower nozzle.
Figure 3:
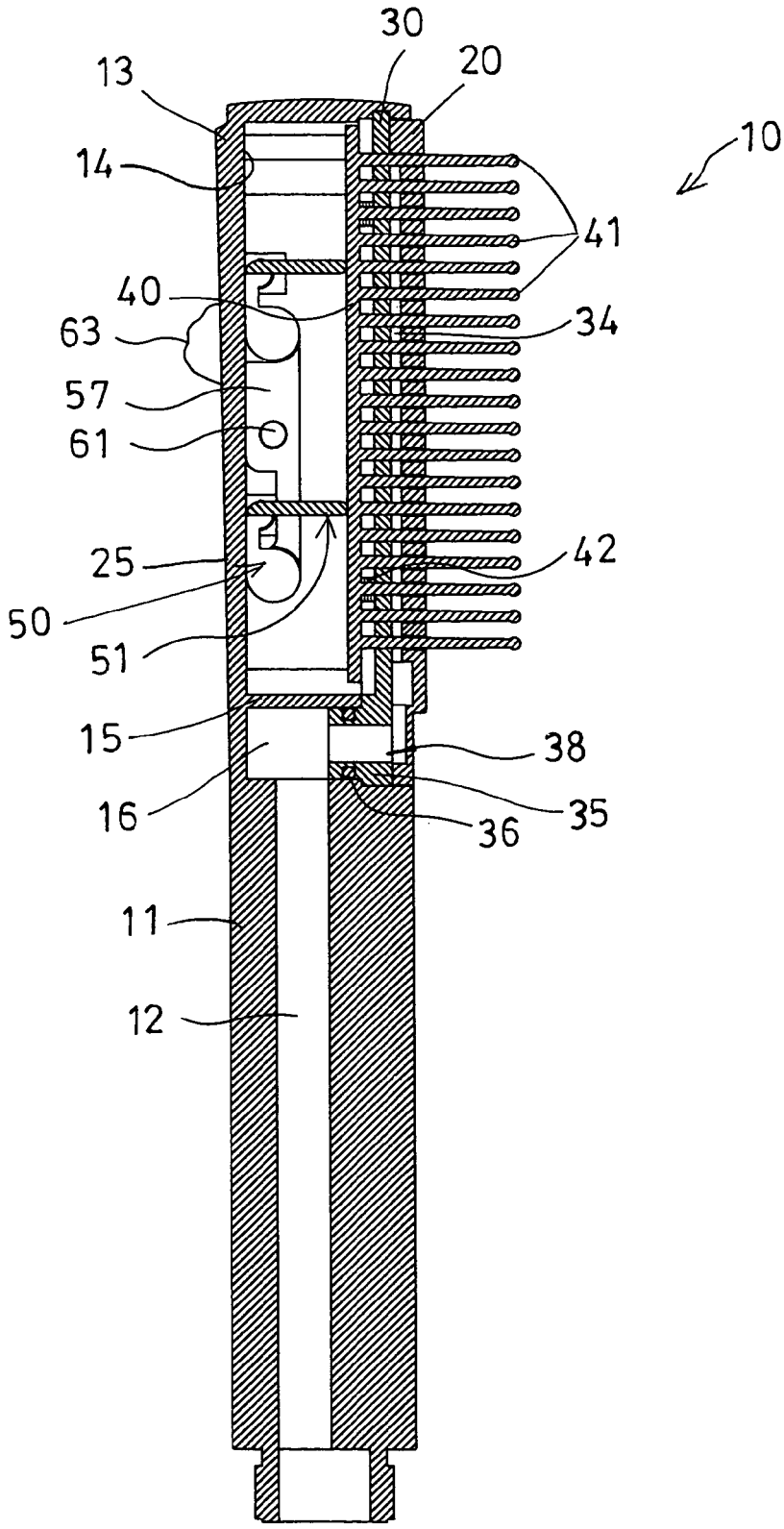
FIGS. 3, 4 are cross sectional views of the shower nozzle, taken along lines 3-3 and 4-4 of FIG. 2 respectively.

Referring to the drawings, and initially to FIGS. 1-4, a shower nozzle 10 in accordance with the present invention comprises a handle or housing 11 including a bore or passage 12 formed therein (FIG. 3) for coupling to a water reservoir and for receiving the water from the water reservoir, and including a head or receptacle 13 formed or disposed or provided on one end of the housing 11 and including a chamber 14 formed therein, and including a conduit or casing 15 formed or disposed or provided in the receptacle 13 and having a cavity 16 formed therein (FIGS. 1, 3) and communicating with the passage 12 of the housing 11 for receiving the water from the passage 12 of the housing 11.

The receptacle 13 may further include one or more, such as two seats 17 disposed or provided in the chamber 14 of the receptacle 13 and further includes one or more, such as two blind holes 18 formed therein (FIG. 1) and communicating with the chamber 14 of the receptacle 13 and preferably aligned with the seats 17 respectively, and further includes an orifice 19 formed therein (FIG. 1), such as formed in one side thereof and located between the blind holes 18 thereof. A face board or cover 20 is attached or secured to the front portion of the receptacle 13 with such as latches or fasteners (not shown) or by welding processes for enclosing the chamber 14 of the receptacle 13, and includes a number of openings 21 and perforations 22 formed therein for allowing the water to flow out through either or both of the openings 21 and the perforations 22 of the cover 20.

Figure 5:
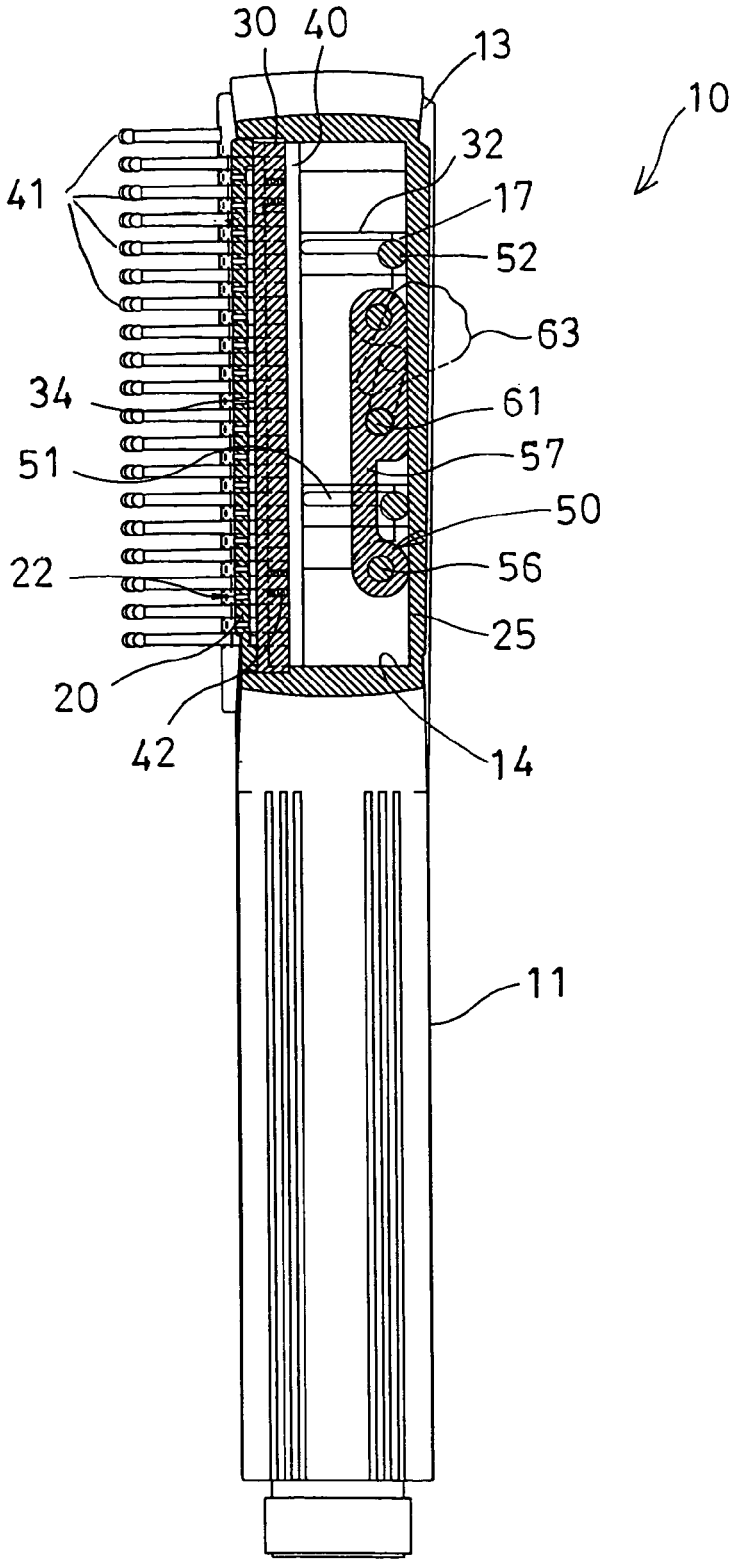
FIG. 5 is a cross sectional view similar to FIG. 4, illustrating the operation of the shower nozzle.

A partition 30 may be disposed in the chamber 14 of the receptacle 13 and may be engaged with the casing 15, and may be secured to the casing 15 and/or the receptacle 13 with such as latches or fasteners 31, and may include one or more, such as two extensions 32 extended therefrom and engaged with the seats 17 of the receptacle 13 (FIG. 5) for suitably spacing the partition 30 from a rear wall 25 of the receptacle 13 and for stably positioning or anchoring the partition 30 to the receptacle 13. It is preferable that the receptacle 13 further includes a peripheral shoulder 26 formed therein (FIG. 1) for engaging with the partition 30 and for further spacing the partition 30 from the rear wall 25 of the receptacle 13 and for stably positioning or anchoring the partition 30 to the receptacle 13.

The partition 30 further includes a number of apertures 33 formed therein and aligned with the openings 21 of the cover 20, and the partition 30 is disposed and spaced from the cover 20 for a predetermined distance in order to form a space 34 between the partition 30 and the cover 20 (FIGS. 3-5), and for allowing the partition 30 to be disposed between the rear wall 25 of the receptacle 13 and the cover 20. The partition 30 further includes a tube 35 extended rearwardly therefrom and engaged into the cavity 16 of the casing 15 for further positioning or anchoring the partition 30 to the receptacle 13. The cover 20 may include one or more, such as two notches 23 formed therein (FIG. 1) and aligned with the fasteners 31 for allowing the fasteners 31 to engage through the cover 20, and one or more, such as two caps 24 for selectively blocking or enclosing the notches 23 of the cover 20.

It is preferable that a sealing ring 36 disposed and engaged between the tube 35 and the casing 15 (FIGS. 1, 3) for making a water tight seal between the tube 35 and the casing 15. The partition 30 includes a pathway 38 formed therein and formed through the tube 35 for communicating the cavity 16 of the casing 15 and the passage 12 of the housing 11 with the space 34 that is formed or defined between the partition 30 and the cover 20 and for allowing the water to flow from the passage 12 of the housing 11 through the cavity 16 of the casing 15 and then through the space 34 that is formed or defined between the partition 30 and the cover 20 and then through the openings 21 and/or the perforations 22 of the cover 20.

Figure 4:
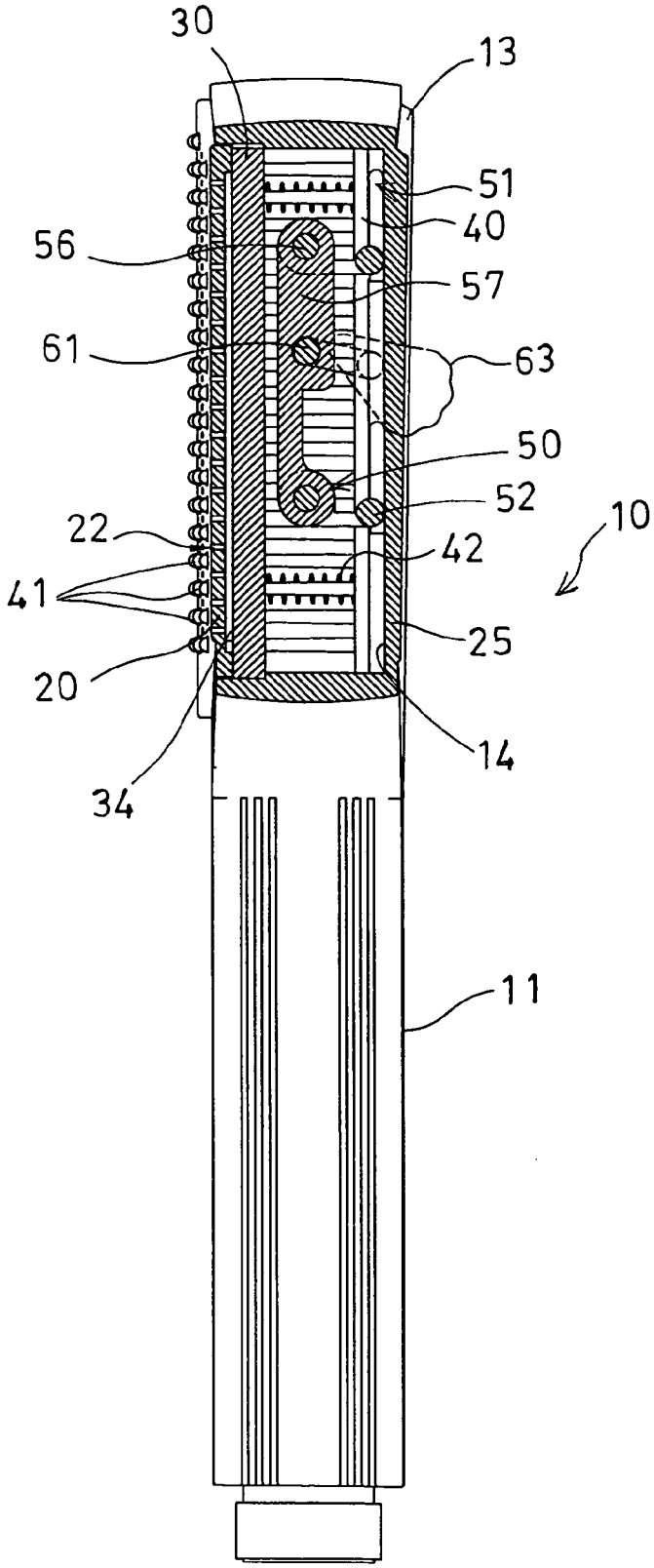

A plate 40 is slidably received or engaged in the chamber 14 of the receptacle 13 and includes a number of bristles or comb teeth 41 extended therefrom and engaged through the apertures 33 of the partition 30 and the openings 21 of the cover 20 for allowing the comb teeth 41 to be selectively extended out of the cover 20 at an outward working position (FIGS. 2-3, 5-6) or to be selectively moved or engaged into the chamber 14 of the receptacle 13 at an inward storing or receiving position (FIG. 4). One or more spring members 42 may be disposed between the partition 30 and the plate 40 for biasing or forcing the plate 40 away from the partition 30 and for moving or engaging the comb teeth 41 into the chamber 14 of the receptacle 13 to the inward storing or receiving position. The plate 40 may further include one or more slots 43 formed therein (FIG. 1) for slidably receiving corresponding guide ribs 44 of the receptacle 13 respectively and for stably guiding the plate 40 to move relative to the receptacle 13.

An operating or actuating means or device 50 may be provided for selectively moving or forcing the comb teeth 41 to move or engage out through the apertures 33 of the partition 30 and the openings 21 of the cover 20, and includes one or more, such as two actuators 51 movably or rotatably disposed in the chamber 14 of the receptacle 13 with a pivot shaft 52 which includes one end 53 engaged into the blind holes 18 of the receptacle 13 respectively and another end 54 engaged between the seats 17 of the receptacle 13 and the extensions 32 of the partition 30 and arranged for allowing the actuators 51 to be engaged with the plate 40 (FIGS. 3, 5) for selectively moving the plate 40 relative to the receptacle 13 and thus for selectively forcing the comb teeth 41 to move out through the apertures 33 of the partition 30 and the openings 21 of the cover 20 to the outward working position.

The actuators 51 each includes an arm 55 extended therefrom, such as extended from the pivot shaft 52 thereof and having a pivot pin 56 extended therefrom. A link 57 may be pivotally coupled to the pivot pins 56 for pivotally coupling the actuators 51 together, and includes a hole 58 formed therein. A crank 60 is rotatably attached to the receptacle 13 and includes one axle 61 engaged into the hole 58 of the link 57 and another axle 62 rotatably engaged through the orifice 19 of the receptacle 13 and coupled to a knob or hand grip 63 which may be used to rotate the crank 60 relative to the receptacle 13 in order to rotate the actuators 51 relative to the receptacle 13 with the link 57 and thus to selectively force the comb teeth 41 to move out through the apertures 33 of the partition 30 and the openings 21 of the cover 20 and to move to the outward working position.

In operation, the water supplied into the passage 12 of the housing 11 may flow through the cavity 16 of the casing 15 and then may flow into the space 34 that is formed or defined between the partition 30 and the cover 20, and then may flow through the openings 21 and/or the perforations 22 of the cover 20 for showering purposes. In addition, the comb teeth 41 may be selectively forced to move out through the apertures 33 of the partition 30 and the openings 21 of the cover 20 to the outward working position to act or perform as a comb, and may be selectively forced to move into the chamber 14 of the receptacle 13 to the inward storing or receiving position.

Figure 6:
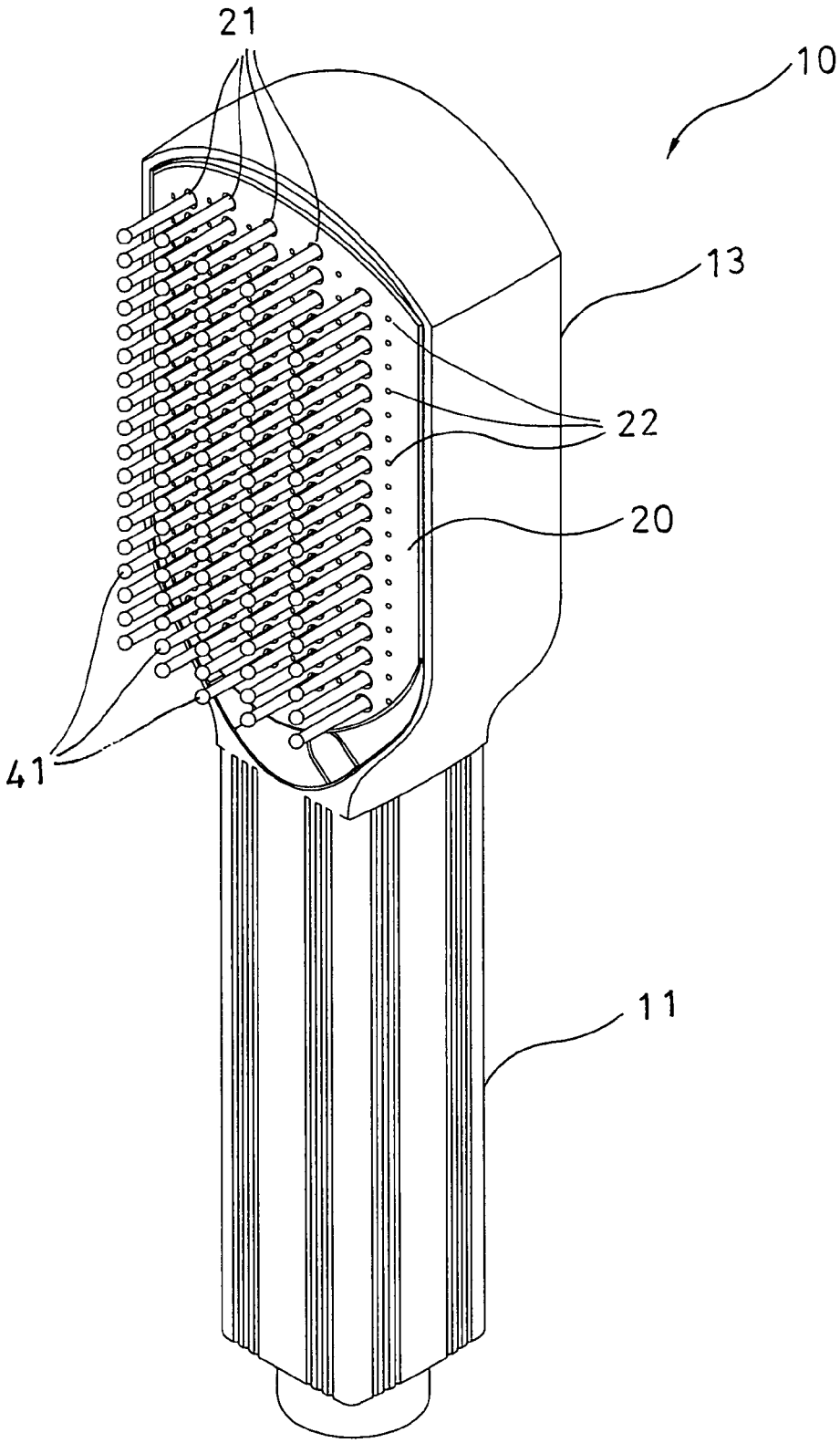
FIG. 6 is a perspective view illustrating the other arrangement of the shower nozzle.

It is to be noted that the operating or actuating means or device 50 may also be replaced with the other slidable moving means or device that may be used to selectively force the comb teeth 41 to move out through the apertures 33 of the partition 30 and the openings 21 of the cover 20 without a hand grip as shown in FIG. 6. In addition, without the partition 30, the water supplied into the passage 12 of the housing 11 may also be guided to flow out through the openings 21 and/or the perforations 22 of the cover 20 for showering purposes. The typical shower nozzles and the typical hair styling devices failed to provide a number of bristles or comb teeth 41 selectively moveable out through the cover 20 to the outward working position to act or perform as a comb, and selectively moveable into the chamber 14 of the receptacle 13 to the inward storing or receiving position when the comb teeth 41 are not required to be used.

Accordingly, the shower nozzle in accordance with the present invention includes a hair styling device slidably attached to the shower nozzle and movable out of the shower nozzle for hair styling purposes and selectively receivable into the shower nozzle for storing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shower nozzle comprising:

a receptacle including a chamber formed therein, and including a partition disposed in said chamber of said receptacle, and including a plurality of apertures formed therein, and including a casing disposed in said receptacle and engaged with said partition for anchoring said partition to said receptacle, a cover attached to a front portion of said receptacle for enclosing said chamber of said receptacle, and including a plurality of openings formed therein, said partition being spaced from said cover to form a space between said partition and said cover, and said partition including a pathway formed therein and communicating with said space which is formed between said partition and said cover, said casing including a cavity formed therein and communicating with said pathway of said partition, and a plate slidably received in said chamber of said receptacle and including a plurality of comb teeth extended therefrom and slidably engaged through said apertures of said receptacle and engaged through said openings of said cover for selectively extending out of said cover to an outward working position and for selectively moving into said chamber of said receptacle to an inward storing position.

2. The shower nozzle as claimed in claim 1, wherein said partition includes a tube extended therefrom and engaged into said cavity of said casing and having said pathway formed therein.

3. The shower nozzle as claimed in claim 1, wherein said partition is secured to said casing of said receptacle with at least one fastener.

4. The shower nozzle as claimed in claim 1, wherein said receptacle includes means for biasing said comb teeth of said plate to move into said chamber of said receptacle.

5. The shower nozzle as claimed in claim 4, wherein said biasing means includes at least one spring member disposed between said partition and said plate for biasing and forcing said plate to move away from said partition.

6. The shower nozzle as claimed in claim 1, wherein said receptacle includes means for selectively actuating said comb teeth of said plate to move out through said openings of said cover.

7. The shower nozzle as claimed in claim 6, wherein said actuating means includes at least one actuator movably disposed in said chamber of said receptacle and engaged with said plate for selectively moving said plate relative to said receptacle and for selectively forcing said comb teeth to move out through said openings of said cover.

8. The shower nozzle as claimed in claim 7, wherein said at least one actuator includes a pivot shaft for rotatably attaching to said receptacle.

9. The shower nozzle as claimed in claim 7, wherein a second actuator is movably disposed in said chamber of said receptacle and engaged with said plate for selectively moving said plate relative to said receptacle and for selectively forcing said comb teeth to move out through said openings of said cover.

10. The shower nozzle as claimed in claim 9, wherein a link couples said at least one and said second actuators together.

11. A shower nozzle comprising:

a receptacle including a chamber formed therein, and including a partition disposed in said chamber of said receptacle and including a plurality of apertures formed therein, said receptacle including a casing disposed in said receptacle and engaged with said partition for anchoring said partition to said receptacle, and said partition being secured to said casing of said receptacle with at least one fastener, a cover attached to a front portion of said receptacle for enclosing said chamber of said receptacle, and including a plurality of openings formed therein, and a plate slidably received in said chamber of said receptacle and including a plurality of comb teeth extended therefrom and slidably engaged through said apertures of said receptacle and slidably engaged through said openings of said cover for selectively extending out of said cover to an outward working position and for selectively moving into said chamber of said receptacle to an inward storing position, and said cover including at least one notch formed therein and aligned with said at least one fastener for allowing said at least one fastener to engage through said cover.

12. The shower nozzle as claimed in claim 11, wherein said cover includes at least one cap attached thereto for selectively blocking and enclosing said at least one notch of said cover.

13. A shower nozzle comprising:

a receptacle including a chamber formed therein, a cover attached to a front portion of said receptacle for enclosing said chamber of said receptacle, and including a plurality of openings formed therein, a plate slidably received in said chamber of said receptacle and including a plurality of comb teeth extended therefrom and engaged through said openings of said cover for selectively extending out of said cover to an outward working position and for selectively moving into said chamber of said receptacle to an inward storing position, means for selectively actuating said comb teeth of said plate to move out through said openings of said cover, said actuating means including at least one actuator movably disposed in said chamber of said receptacle and engaged with said plate for selectively moving said plate relative to said receptacle and for selectively forcing said comb teeth to move out through said openings of said cover, a second actuator movably disposed in said chamber of said receptacle and engaged with said plate for selectively moving said plate relative to said receptacle and for selectively forcing said comb teeth to move out through said openings of said cover, a link coupling said at least one and said second actuators together, and a crank rotatably attached to said receptacle and including a first axle engaged with said link and a second axle rotatably engaged with said receptacle.

14. The shower nozzle as claimed in claim 13, wherein a hand grip is secured to said second axle of said crank for rotating said crank and said at least one and said second actuators relative to said receptacle.

15. A shower nozzle comprising:

a receptacle including a chamber formed therein, a cover attached to a front portion of said receptacle for enclosing said chamber of said receptacle, and including a plurality of openings formed therein, a plate slidably received in said chamber of said receptacle and including a plurality of comb teeth extended therefrom and engaged through said openings of said cover for selectively extending out of said cover to an outward working position and for selectively moving into said chamber of said receptacle to an inward storing position, means for selectively actuating said comb teeth of said plate to move out through said openings of said cover, said actuating means including at least one actuator movably disposed in said chamber of said receptacle and engaged with said plate for selectively moving said plate relative to said receptacle and for selectively forcing said comb teeth to move out through said openings of said cover, a second actuator movably disposed in said chamber of said receptacle and engaged with said plate for selectively moving said plate relative to said receptacle and for selectively forcing said comb teeth to move out through said openings of said cover, a link coupling said at least one and said second actuators together, and said at least one and said second actuators each including an arm extended therefrom and having a pivot pin for pivotally coupling to said link.

* * * * *